US007419396B2

(12) United States Patent
Sakamoto et al.

(10) Patent No.: US 7,419,396 B2
(45) Date of Patent: Sep. 2, 2008

(54) WATERPROOF CONNECTOR

(75) Inventors: Nobuyuki Sakamoto, Shizuoka (JP); Keiko Azuma, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/783,650

(22) Filed: Apr. 11, 2007

(65) Prior Publication Data

US 2007/0281530 A1 Dec. 6, 2007

(30) Foreign Application Priority Data

Jun. 5, 2006 (JP) ..... 2006-155844

(51) Int. Cl.
*H01R 13/52* (2006.01)

(52) U.S. Cl. ..... 439/271

(58) Field of Classification Search ..... 439/271, 439/588, 587, 589, 274, 275, 586, 752, 752.5, 439/598, 599
See application file for complete search history.

(56) References Cited

U.S. PATENT DOCUMENTS 5,762,524 A * 6/1998 Ford et al. ..... 439/589
6,152,752 A * 11/2000 Fukuda ..... 439/275

FOREIGN PATENT DOCUMENTS

JP 2000-208200 7/2000
JP 2000294336 A * 10/2000

* cited by examiner

*Primary Examiner*—Edwin A. León
(74) *Attorney, Agent, or Firm*—Kratz, Quintos & Hanson, LLP

(57) ABSTRACT

The present invention is to provide a waterproof connector having an adjusted spacing between terminals or electrical wires for achieving an effective waterproof. The electrical wires received in a terminal receiving portion of an outer housing are guided to a wire seal fit portion, while the electrical wires are pressed with wire holders (displacement limit portions). The electrical wires are then passed through a holder (spacing adjusting portion), a seal member, and another holder (lead-out portion) of a wire seal in the wire seal fit portion. The wire seal is fitted into the wire seal fit portion for achieving waterproof of the waterproof connector. The electrical wires guided out of the lead-out portion have an equal spacing therebetween by expansion of the spacings between the electrical wires or displacements thereof. The equal spacing ensures insertion of the seal member and provides the effective waterproof.

6 Claims, 9 Drawing Sheets

WATERPROOF CONNECTOR

BACKGROUND OF THE INVENTION

1. Field of the Invention

The present invention relates to a waterproof connector including a terminal receiving portion, which receives a terminal connected with an electrical wire to connect an electronic circuitry, and a wire seal fit portion, which waterproofs the electrical wire guided out of the terminal receiving portion.

2. Description of Related Art

JP2000-208200, A discloses a conventional waterproof connector including a terminal receiving portion and a waterproof portion to prevent water from entering the terminal receiving portion.

FIG. 6 illustrates a configuration of the conventional waterproof connector of JP2000-208200,A. In the waterproof connector 1, a female terminal 104 having a box shaped electrical contact portion 105 is received in a terminal receiving chamber 103 of a housing 102. A mat seal 106 having a plurality of through holes 107 is attached to a rear end of the terminal receiving chamber 103 for sealing an electrical wire. The mat seal 106 is interposed between the housing 102 and a mat seal cover 113 so as to hold the mat seal 106 at the rear end of the terminal receiving chamber 103.

In the conventional waterproof connector, when a spacing or distance between the female terminals 104 becomes smaller than a prescribed value, the spacing between the electrical wires guided out of the female terminals 104 also becomes small. It becomes difficult to put the mat seal 106 between the electrical wires for waterproofing the connector, resulting to a reduction of sealability.

It is necessary to provide a seal member, such as the mat seal, with a thickness and spacing between the terminals and between the electrical wires to effectively waterproof the electrical wires guided out of the terminal. The electrical wires are straight led out of the terminals and the spacing therebetween depends on the spacing between the terminals. The spacing of the terminals has a limit for reduction. The spacings between the terminals and between the electrical wires have an irregular size, wide or narrow portion, so that the uniform and effective waterproofing is difficult. It is desired that the waterproof connector has a small size and is adapted to a variety of the terminals to be received.

SUMMARY OF THE INVENTION

An object of the present invention is to provide a waterproof connector having an adjusted spacing between electrical wires depending on terminals for effectively waterproofing the connector.

According to a first aspect of the present invention, a waterproof connector includes an outer housing including a terminal receiving portion and a wire seal fit portion, wherein the terminal receiving portion includes a plurality of terminal receiving chambers, and the terminal receiving chambers receive a plurality of terminals connected with electrical wires with a first spacing; and the wire seal fit portion includes a wire seal, the wire seal including a lead-out portion for guiding outside the electrical wires, a seal member disposed between the terminal receiving portion and the lead-out portion for allowing the plurality of the electrical wires to pass therethrough, and a spacing adjusting portion disposed between the terminal receiving chambers and the seal member for adjusting the first spacing to a second spacing.

Preferably, the spacing adjusting portion adjusts at least two different adjacent spacings of the electrical wires to the second spacing, which is larger than the narrowest spacing among the at least two different spacings.

Preferably, the spacing adjusting portion includes a plurality of spacing adjusting plates piled-up each other.

Preferably, the plurality of the spacing adjusting plates are integral with a seal member.

Preferably, the terminal receiving portion includes an inner housing having a plurality of inner plates piled-up each other, each inner plate having the plurality of the terminal receiving chambers disposed in parallel, and the each inner plate has a displacement limit portion at an outer surface of a rear end portion thereof for limiting displacement of the electrical wires disposed below to a prescribed quantity.

Preferably, the outer housing has a packing at a rear end portion of the terminal receiving portion, the packing abutting on a front end of an outer circumference portion of the wire seal fit portion for keeping water-tight between the waterproof connector and a mating connector.

DETAILED DESCRIPTION OF THE PREFERRED EMBODIMENTS

Figure 1:
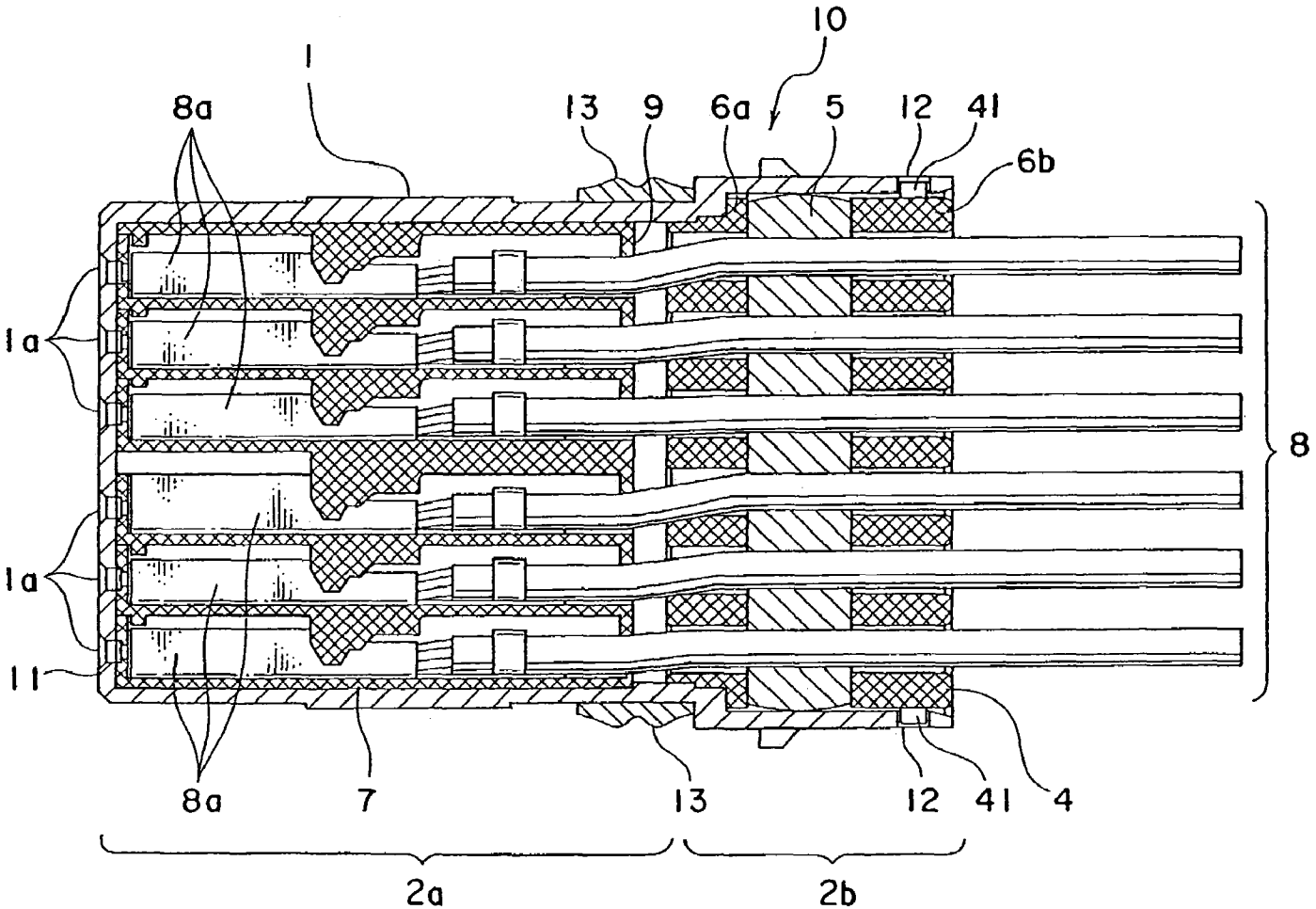
FIG. 1 is a vertical sectional view of an embodiment of a waterproof connector of the present invention.
Figure 3:
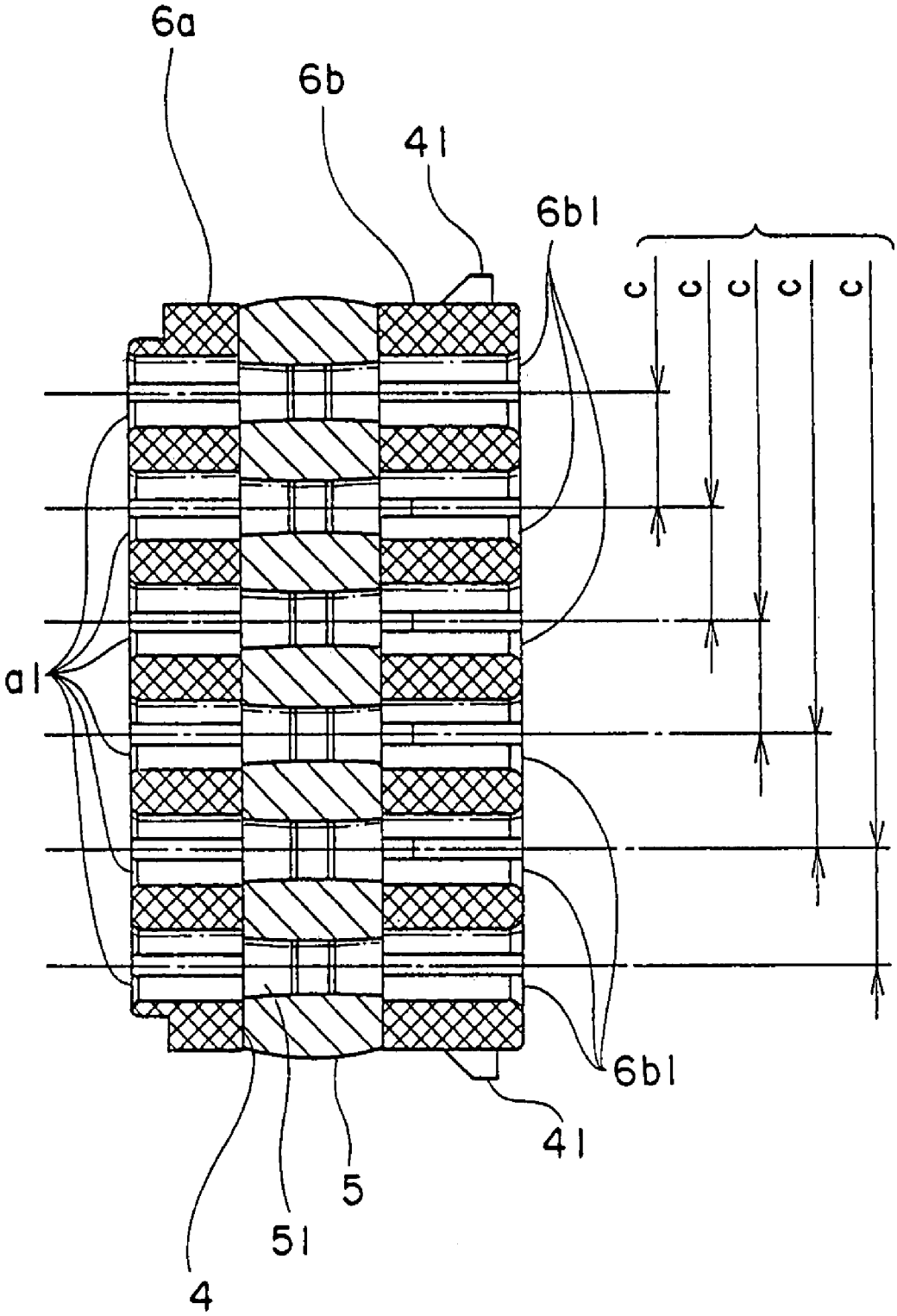
FIG. 3 is a sectional view of the wire seal of the waterproof connector.
Figure 7:
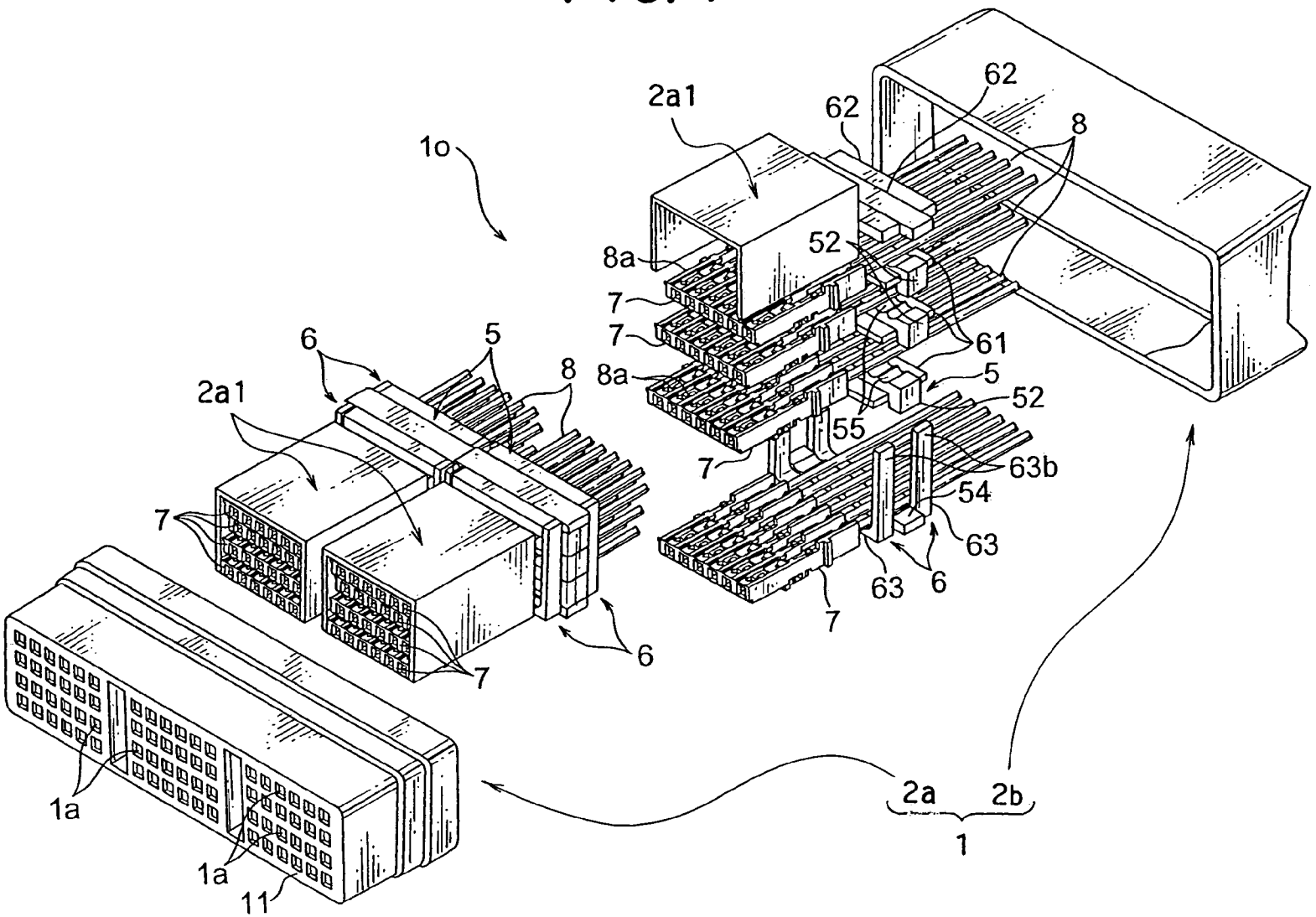
FIG. 7 is a perspective view showing the entire configuration of the embodiment of the waterproof connector of the present invention.

Preferred embodiments are explained by referring to drawings. FIGS. 1 and 7 show a configuration of a waterproof connector of the present invention. A waterproof connector 10 includes an outer housing 1 and a wire seal 4. The outer housing 1 includes a terminal receiving portion 2*a*, which has a plurality of terminal receiving chambers for receiving a plurality of terminals 8*a*, and a wire seal fit portion 2*b* to accept the wire seal 4. Referring to FIGS. 1 and 3, the wire seal 4 includes a plurality of first insertion portions 6*a*1 and a plurality of second insertion portions 6*b*1 for entry of a plurality of the electrical wires 8 guided out of the terminal receiving portion 2*a*. The wire seal 4 adjusts spacings of the adjacent electrical wires 8, which pass through the first insertion portions 6*a*1, to an equal spacing so as to waterproof the electrical wires 8. The wire seal 4 includes holders 6*a* (spacing adjusting portion), 6*b* (lead-out portion) respectively having the first and second insertion portions 6*a*1, 6*b*1 for accepting the plurality of the electrical wires 8 and a seal member 5 for waterproofing the electrical wires 8 passing through the first insertion portions 6*a*1 of the holder 6*a*.

Figure 2:
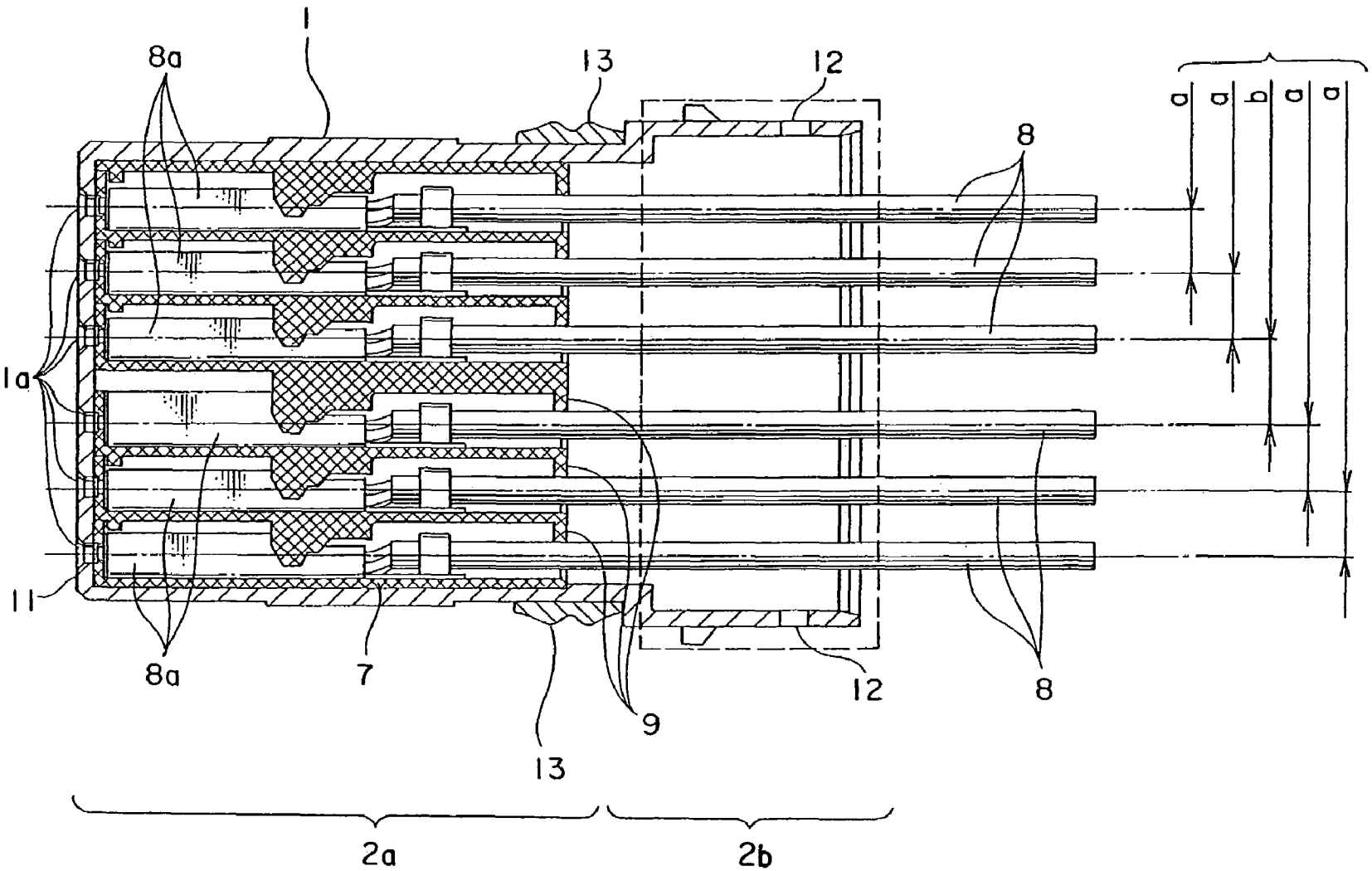
FIG. 2 is a vertical sectional view of the waterproof connector prior to fitting a wire seal into a wire seal fit portion.
Figure 8:
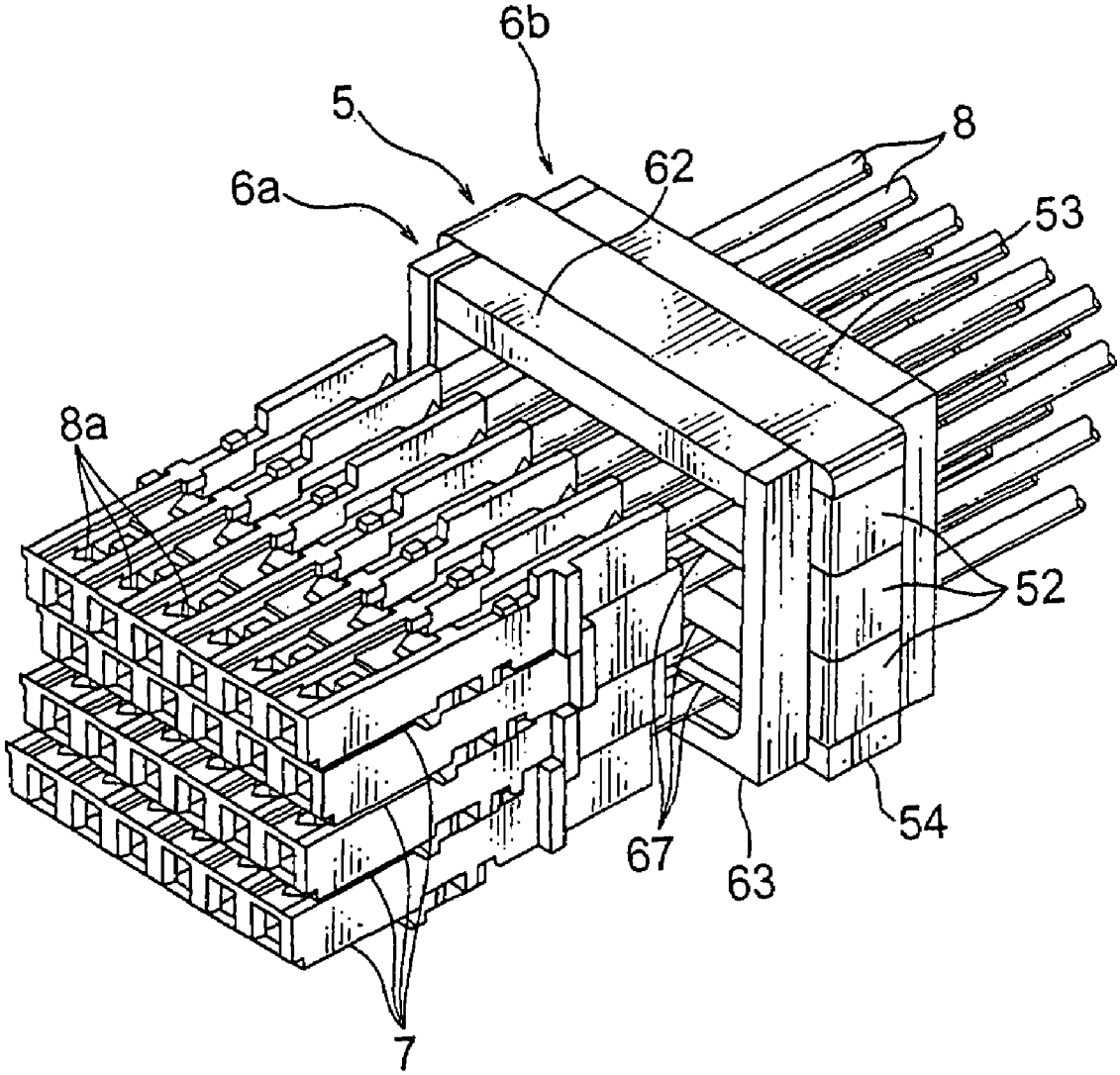
FIG. 8 is a perspective view showing a terminal receiving portion of the waterproof connector of the present invention.

FIG. 2 illustrates a configuration of the outer housing 1 and FIG. 8 illustrates a configuration of the terminal receiving portion 2*a*. The outer housing 1 is formed with an electrical insulation synthetic resin and includes the box shaped terminal receiving portion 2*a*, having an opening to accept at least one inner housing 2*a*1 opposite to a mating connector to be connected, and the tube shaped wire seal fit portion 2*b*.

As shown in FIG. 8, the inner housing 2*a*1 received in the terminal receiving portion 2*a* has a plurality of inner plates 7 layered each other. Each inner plate 7 includes a plurality of terminal receiving chambers, which are juxtaposed and separated with partition walls, and the terminal receiving chambers each receive the terminal 8*a* of the associated electrical wire 8. A front end of the outer housing 1 faces to the mating connector to be connected and has a wall 11 having a plurality of connection holes 1*a* for accepting terminals of the mating connector to connect to the respective terminals 8*a*.

The terminals 8*a* holding electrical conductors of the electrical wires 8 in the inner plates 7 are connected with the terminals of the mating connector. Each terminal 8*a* is formed with a conductive material such as metals and includes a connection portion to be connected with the mating terminal, a force-press portion for force-pressing the core wire, and a crimp portion for crimping the electrical wire 8.

As shown in FIG. 2, each inner plate 7 has a wire holder (displacement limit portion) 9 disposed on a rear end thereof to limit a displacement of the associated electrical wire 8 within a prescribed quantity.

As shown in FIGS. 1 and 2, each wire holder 9 is disposed at the rear end of the associated terminal receiving chamber and projects downwardly from a lower wall of the chamber. The wire holders 9 (downward projections) limit rear end openings of the terminal receiving chambers to the extent of a diameter of the electrical wires 8. When the spacings of the electrical wires 8 in the respective adjacent inner plates 7 are adjusted with the wire seal 4, the electrical wires 8 tend to bend. The wire holders 9 (downward projections) limit upward movement of the electrical wires 8, by the prescribed quantity, from bottom walls of the terminal receiving chambers.

The terminals 8*a* are received in the respective inner plates 7 with at least two different spacings of the inner plates 7 (a first spacing) as shown in FIG. 2. The wire seal fit portion 2*b* is disposed on the rear end of the terminal receiving chambers. The wire seal 4 including the holders 6*a* (spacing adjusting portion), 6*b* (lead-out portion) and the seal member 5 is fitted into the wire seal fit portion 2*b*.

The wire seal fit portion 2*b* has the tube shape and is linked with the rear portion of the terminal receiving portion 2*a*. An outer circumference of the wire seal fit portion 2*b* is positioned outside about an outer circumference of the terminal receiving portion 2*a*. The wire seal fit portion 2*b* has an engaging hole 12 at an upper and a lower wall, respectively to be engaged with engaging portions 41. A packing 13 is disposed on an outer circumference of the outer housing 1 and positioned at a front end of the wire seal fit portion 2*b* so as to keep watertight between the outer surface of the outer housing 1 and an inner surface of a hood of the mating connector when they are connected together.

FIG. 3 illustrates a configuration of the wire seal 4. As shown in FIGS. 3 and 8, the wire seal 4 includes the holders 6*a* and 6*b*, and the seal member 5. The holders 6*a* and 6*b* accept the electrical wires 8 guided out of the inner housing 2*a*1, adjust the spacings between the electrical wires 8 to the prescribed spacing, and rearwardly guide the electrical wires 8. The seal member 5 waterproofs the electrical wires 8 between the holders 6*a*, 6*b*. The wire seal 4, which is arranged with the order of the holder 6*a*, the seal member 5, and the holder 6*b*, is fitted into the wire seal fit portion 2*b*.

The holder 6*a* (spacing adjusting portion) is made of an insulation synthetic resin. The insertion portions 6*a*1 having horizontally elongated openings for accepting the electrical wires 8 guided out of the inner housing 2*a*1 are separately Piled up each other. The electrical wires 8 are passed through the insertion portions 6*a*1 so as to achieve an equal prescribed spacing (a second spacing) between the electrical wires 8 of the respective adjacent inner plates 7. The prescribed spacing (the second spacing) between the insertion portions 6*a*1 is, for example, 3-4 mm, which is the minimum spacing for waterproof with the seal member 5, or larger than the narrowest spacing among the spacings of the at least two spacings between the respective adjacent inner plates 7. The holder 6*a* guide guides the electrical wires 8 to a rear side of the waterproof connector 10 via the seal member 5 and the holder 6*b*. When the spacings between the adjacent inner plates 7 each are different and are adjusted to the minimum spacing for waterproof, for example 3-4 mm, it is not necessary to dispose the insertion portions 6*a*1 with the equal spacing.

As shown in FIG. 3, the holder 6*b* includes a plurality of the second insertion portions 6*b*1, which have horizontally elongated openings and are piled up each other with the same spacing as the first insertion portions 6*a*1 of the holder 6*a*, for guiding the electrical wires 8 to a rear side of the wire seal 4. As shown in FIG. 1, the electrical wires 8 guided out of the respective inner plates 7 with the different spacings (the first spacing) are guided to the rear of the waterproof connector 10 through the wire seal 4, which keeps the spacing between the electrical wires 8 with the equal spacing (the second spacing) through the first and second insertion portions 6*a*1 and 6*b*1.

Figure 4:
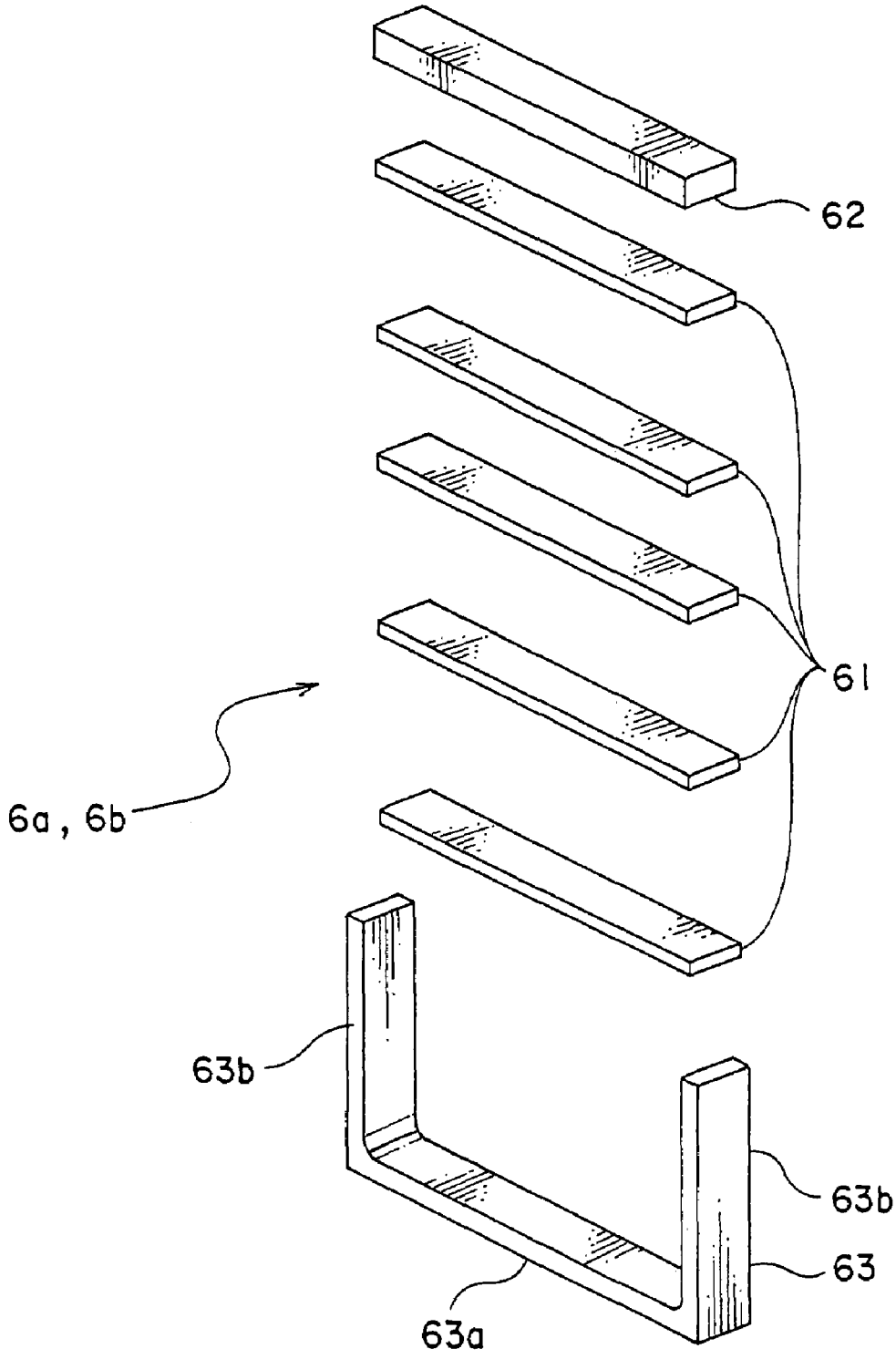
FIG. 4 illustrates a configuration of a holder of the waterproof connector.
Figure 9:
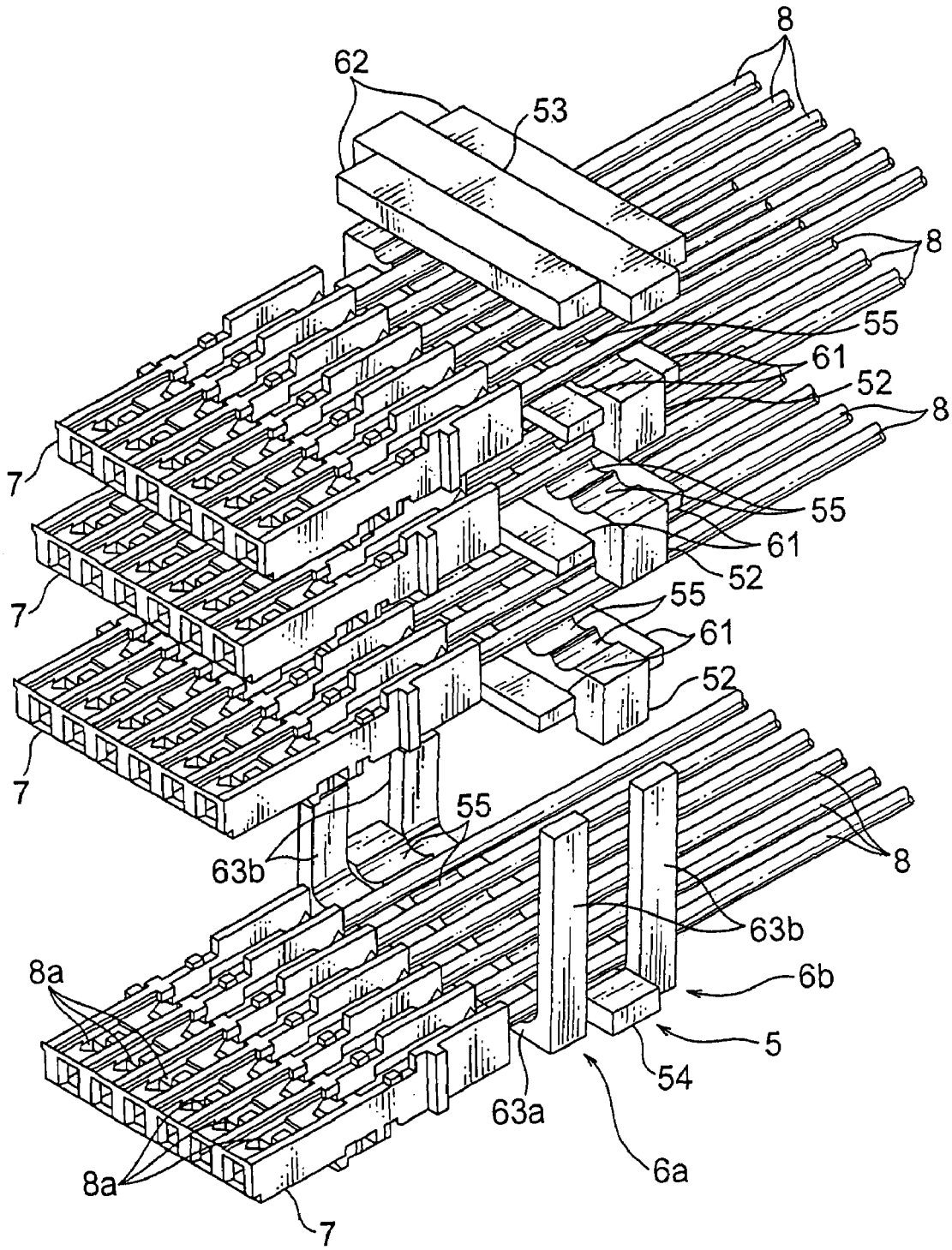
FIG. 9 is a perspective view showing the holders of the waterproof connector of the present invention.

FIGS. 4 and 9 illustrate a configuration of the holders 6*a* and 6*b*. The holders 6*a* and 6*b* include a plurality of holder middle portions 61, a holder upper portion 62, and a holder lower portion 63. The holder middle portions 61 of the holder 6*a* (spacing adjusting portion) function to separate the electrical wires 8 with the second spacing and are referred to spacing adjusting plates. Referring to FIGS. 4 and 9, the plurality of the holder middle portions 61 form the first and second insertion portions 6*a*1 and 6*b*1 to separately accept the juxtaposed electrical wires 8 of the respective inner plates 7. The holder upper portions 62 and the holder lower portions 63 hold the respective electrical wires 8 positioned on the uppermost insertion portions 6*a*1, 6*b*1 and lowermost insertion portions 6*a*1, 6*b*1 with the associated adjacent holder middle portions 61. Thereby, the holder upper portions 62, the holder middle portions 61, and the holder lower portions 63 form the insertion portions 6*a*1 and 6*b*1 to guide the electrical wires 8 therebetween.

As shown in FIG. 3, the spacing between the holder middle portions 61 and the holder upper portion 62 is same as the spacing between the centers of the insertion portions 6*a*1 and 6*b*1 as described above.

The holder lower portions 63 each has a bottom portion 63*a*, which has a length same as the total width of the terminals 8*a* of the associated inner plate 7, and connection portions 63*b* upstanding from both ends of the bottom portion 63*a* for supporting the holder middle portions 61 (spacing adjusting plates for the holder 6*a*) and the holder upper portion 62. The bottom portions 63*a* hold the electrical wires 8 of the lowermost position and form the first and second insertion portions 6*a*1 and 6*b*1. The connection portions 63*b* support respective ends of the holder middle portions 61 and the holder upper portions 62 to position them with the equal spacing described above.

As shown in FIGS. 8 and 9, the plurality of the juxtaposed electrical wires each are held between the associated holder middle, upper, and lower portions 61-63 to integrally form the holders 6*a* and 6*b*. The horizontally elongated openings of the first and insertion portions 6*a*1 and 6*b*1 are thus defined by lower surfaces of the holder upper portions 62, lower and upper surfaces of the holder middle portions 61, upper surfaces of the holder lower portions 63, and inner surfaces of the connection portions 63*b*.

The seal member 5 is formed with a resilient elastomer. The seal member 5 has seal insertion holes 51 to accept the electrical wires 8 and keep water-tight between the electrical wires 8 and the seal member 5.

Figure 5:
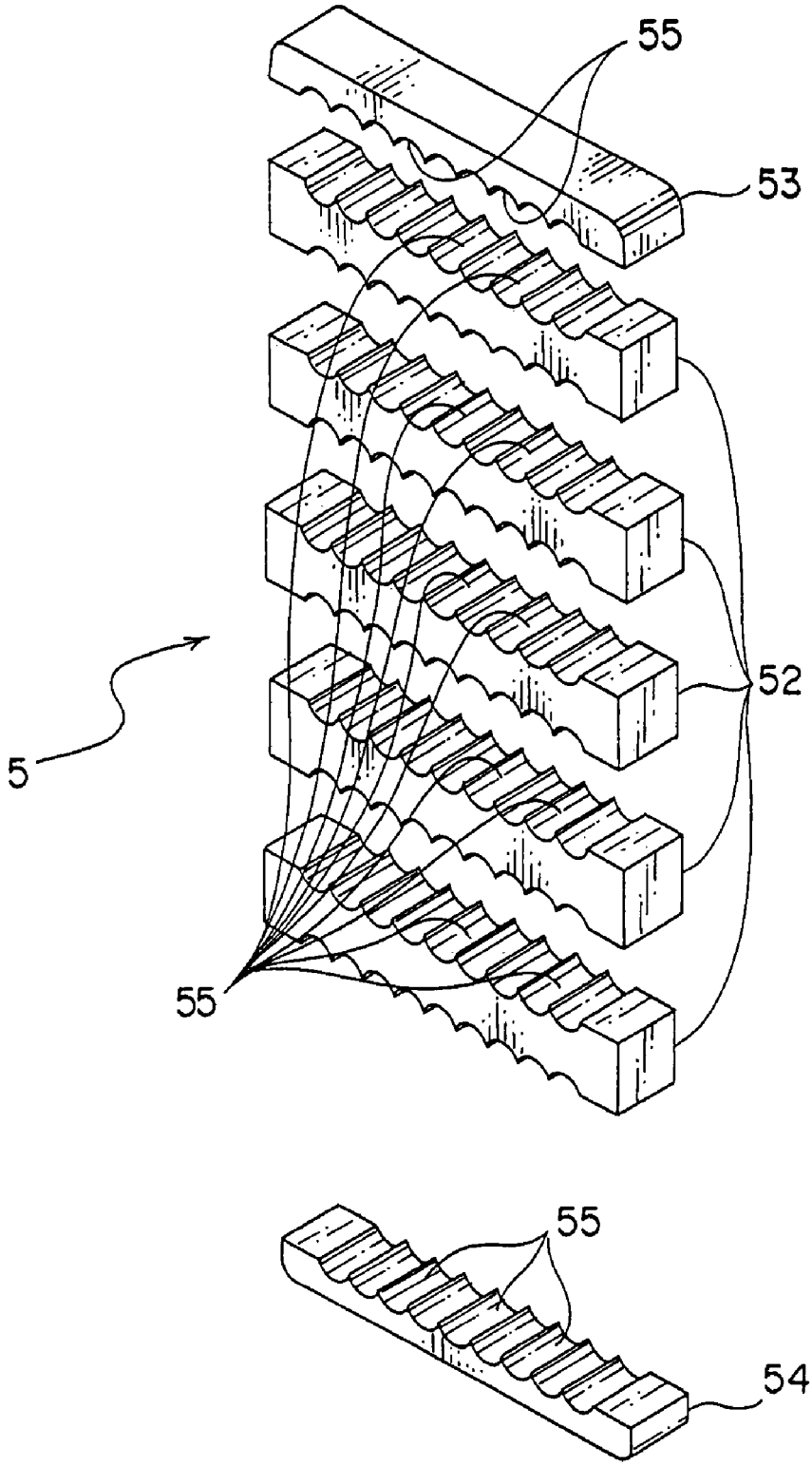
FIG. 5 illustrates a configuration of a seal member of the waterproof connector.
Figure 6:
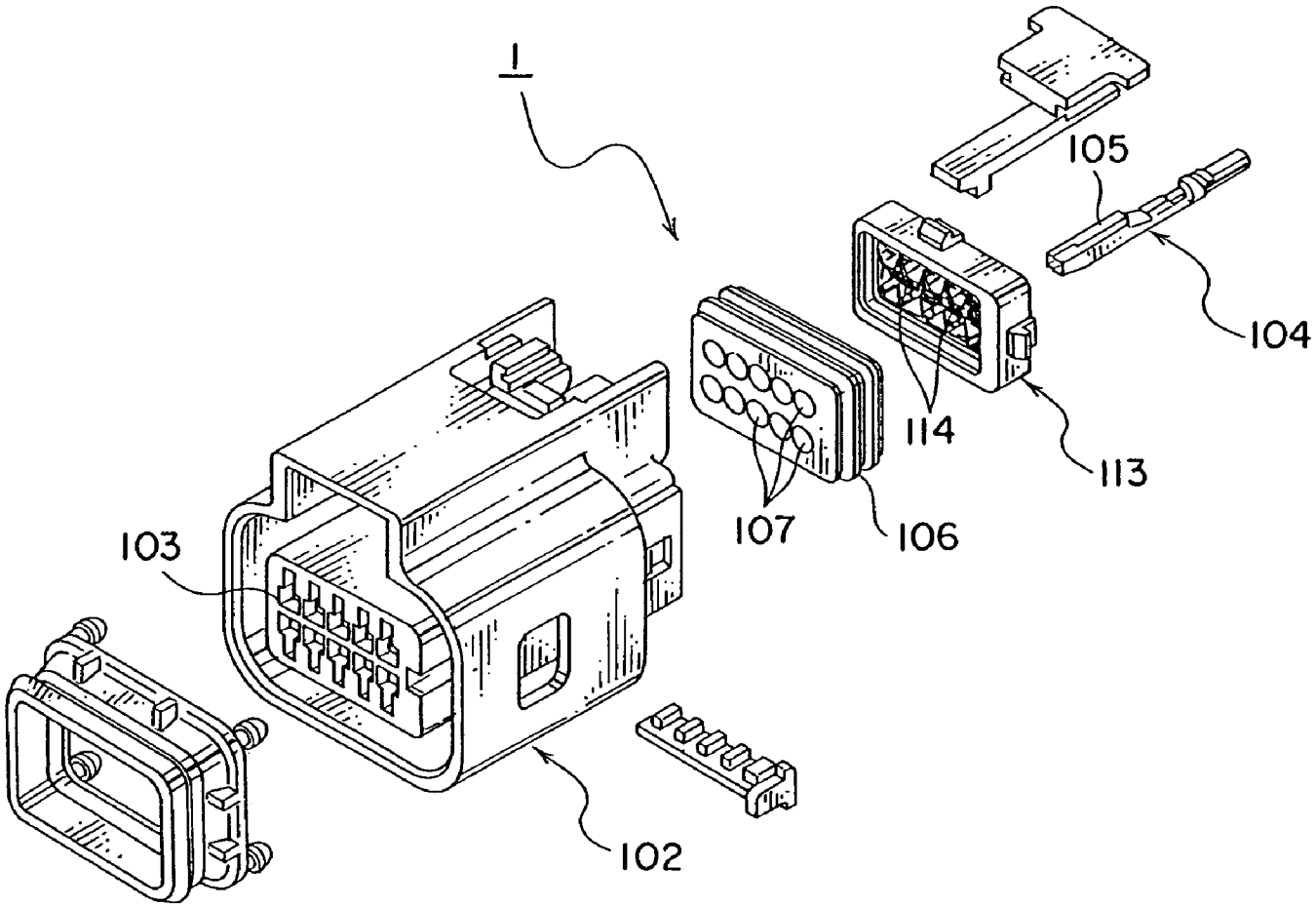
FIG. 6 PRIOR ART
FIG. 6 illustrates a configuration of a conventional waterproof connector.

Referring to FIG. 5, the seal member 5 includes seal middle portions 52, a seal upper portion 53, and a seal lower portion 54. The seal middle portions 52 hold the electrical wires 8 guided to the second insertion portions 6*b*1. The seal upper and lower portions 53, 54 hold the electrical wires 8 with the respective adjacent holder middle portions 52 for waterproof. The seal middle portions 52, the upper portion 53, and the lower portion 54 form the seal insertion holes 51 through which the electrical wires 8 are passed.

The seal middle portions 52 each have a width same as the entire width of the terminals 8*a* of the associated inner plate 7 and a plurality of semicircular recesses 55 at upper and lower surfaces thereof to mount the electrical wires 8. The plurality of the semicircular recesses 55 have an inner diameter equal to or a little smaller than the diameter of the electrical wires 8. The seal insertion holes 51 are defined by combination of the seal middle portions 52, the seal upper portion 53, the seal lower portion 54, and the recesses 55. A thickness of each seal middle portion 52 is formed to match the prescribed spacing, with which the insertion portions 6*a*1 and 6*b*1 are disposed.

The seal upper portion 53 and lower portion 54 have a width same as the entire width of the terminals 8*a* of the associated inner plate 7.

The wire seal 4 has the engaging portion 41 at an upper and lower surface thereof, respectively. The engaging portions 41 engage the engaging holes 12 disposed on an upper surface and lower surface of an interior side of the wire seal fit portion 2*b* so as to fix the wire seal 4 to the wire seal fit portion 2*b*.

The electrical wires 8 of the respective inner plate 7 are mounted on the associated semicircular recesses 55 of the respective seal middle portions 52 and held with the combination of the seal middle, upper, and lower portions 52-54. The entire size of the outer circumference of the seal member 5 becomes a little larger than that of the inner circumference of the wire seal fit portion 2*b*. The outer circumference of the seal member 5 is pressed inwardly and force-pressed into the wire seal fit portion 2 to fit the wire seal 4 into the wire seal fit portion 2*b*. The seal member 5 seals the electrical wires 8 with a certain contact pressure at the seal insertion holes 51 and keeps water-tight between the electrical wires 8 and the seal member 5.

The embodiment of the waterproof connector 10 of the present invention provides the following effects. The terminals 8*a* are fixed on the terminal receiving chambers of the respective inner plates 7 piled-up each other. The electrical wires 8 attached to the terminals 8*a* are guided out of the rear portions of the respective inner plates 7 while the electrical wires 8 are pressed with the associated wire holders 9 (displacement limit portions). The electrical wires 8 are then inserted to the wire seal 4 via the holder 6*a* and guided out of the holder 6*b*.

The wire seal 4 is then fitted to the wire seal fit portion 2*b* of the outer housing 1 to form an integral structure of the waterproof connector 10. As shown in FIG. 2, the spacings between the electrical wires 8 of the adjacent inner plates 7 are not equal each other but have the values of a, b, or others. The spacing such as a is not enough long for waterproof with the seal member 5 so that the electrical wires 8 separated by the spacing a can not be well waterproofed with the seal member 5. As shown in FIGS. 1 and 3, the spacing between the adjacent electrical wires 8 guided out of the rear of the wire seal 4 is expanded when they pass through the second insertion portions 6*b*1 of the holder 6*b*, or is displaced to be positioned into the constant value, for example c, resulting to the equal spacing. The spacing between the adjacent electrical wires 8 is maintained for accepting the seal member 5 so that the seal member 5 ensures waterproof of the connector.

The conventional waterproof connector has a non-uniform spacing between the adjacent electrical wires so that the electrical wires are not uniformly waterproofed. The area having the narrow spacing cannot be waterproofed. The waterproof connector 10 of the present invention provides enough thickness or spacing for the seal member 5 and permits the seal member 5 to uniformly and effectively waterproof.

When the electrical wires 8 pass through the first insertion portions 6*a*1 of the holder 6*a* and are displaced from the lower surfaces of the interiors of the inner plates 7 for adjusting the spacing, the wire holders 9 press the electrical wires 8 to limit the displacements from the lower surfaces so that the electrical wires 8 are prevented from being pulled out of the terminals 8.

The seal member 5 is integrally formed with the holders 6*a* and 6*b*. They can be separated each other.

The first insertion portions 6*a*1 of the holder 6*a* are flat and horizontal. The first insertion portions 6*a*1, however, may be beveled from front ends to rear ends thereof. The front ends correspond to the positions of the electrical wires 8 guided out of the inner plates 7 and the rear ends corresponds to the prescribed equal spacing. This configuration prevents damage to the electrical wires 8 when the electrical wires 8 are inserted into the first insertion portions 6*a*1 and the core wires and the electrical insulations thereof are subjected to a load.

The holders 6*a* and 6*b* are assembled with the holder middle portions 61 and the holder upper portions 62, respectively when they are utilized. The holders 6*a* and 6*b* can be integrally formed and have the insertion portions 6*a*1 and 6*b*1 disposed with the prescribed equal spacing. The integrally formed holders 6*a* and 6*b* may have a plurality of insertion holes allowing the electrical wires 8 to pass with the prescribed equal spacing.

What is claimed is:

1. A waterproof connector comprising:

an outer housing including a terminal receiving portion and a wire seal fit portion, wherein the terminal receiving portion includes a plurality of terminal receiving chambers, and the terminal receiving chambers receive a plurality of terminals connected with electrical wires having a first spacing; and the wire seal fit portion includes a wire seal, the wire seal including a lead-out portion for guiding outside the electrical wires having a second spacing, a seal member, formed of a seal upper portion, seal lower portion and seal middle portions which form insertion holes through which the electric wires pass, disposed between the terminal receiving portion and the lead-out portion for allowing the plurality of the electrical wires to pass therethrough, and a spacing adjusting portion disposed between the terminal receiving chambers and the seal member, the spacing adjusting portion having insertion portions arranged to adjust the first spacing of the electric wires to said second spacing.

2. The waterproof connector as claimed in claim 1, wherein the spacing adjusting portion adjusts at least two different adjacent first spacings of the electrical wires to the second spacing, which is larger than the narrowest spacing among the at least two different spacings.

3. The waterproof connector as claimed in claim 1, wherein the terminal receiving portion includes an inner housing having a plurality of inner plates piled-up on each other, each inner plate having the plurality of the terminal receiving chambers disposed in parallel, and each inner plate has a displacement limit portion at an outer surface of a rear end portion thereof for limiting displacement of the electrical wires disposed below to a prescribed quantity.

4. The waterproof connector as claimed in claim 1, wherein the outer housing has a packing at a rear end portion of the terminal receiving portion, the packing abutting on a front end of an outer circumference portion of the wire seal fit portion for keeping water-tight between the waterproof connector and a mating connector.

5. The waterproof connector as claimed in claim 1, wherein the spacing adjusting portion includes a plurality of spacing adjusting plates piled-up on each other.

6. The waterproof connector as claimed in claim 5, wherein the plurality of the spacing adjusting plates are integral with a seal member.

* * * * *